US008733726B2

(12) United States Patent
Maier

(10) Patent No.: US 8,733,726 B2
(45) Date of Patent: May 27, 2014

(54) COMPRESSOR MOUNTING SYSTEM

(75) Inventor: William C. Maier, Almond, NY (US)

(73) Assignee: Dresser-Rand Company, Olean, NY (US)

( * ) Notice: Subject to any disclaimer, the term of this patent is extended or adjusted under 35 U.S.C. 154(b) by 1127 days.

(21) Appl. No.: 12/442,863

(22) PCT Filed: Sep. 25, 2007

(86) PCT No.: PCT/US2007/079350

§ 371 (c)(1), (2), (4) Date: May 7, 2009

(87) PCT Pub. No.: WO2008/039733

PCT Pub. Date: Apr. 3, 2008

(65) Prior Publication Data

US 2010/0090087 A1 Apr. 15, 2010

Related U.S. Application Data

(60) Provisional application No. 60/826,876, filed on Sep. 25, 2006.

(51) Int. Cl.

| | |
|---|---|
| ***F16M 1/00*** | (2006.01) |
| ***F16M 3/00*** | (2006.01) |
| ***F16M 5/00*** | (2006.01) |
| ***F16M 7/00*** | (2006.01) |
| ***F16M 9/00*** | (2006.01) |
| ***F16M 11/00*** | (2006.01) |

(52) U.S. Cl.
USPC ..... 248/678; 248/637; 248/638; 248/346.03; 417/363

(58) Field of Classification Search
USPC ..... 248/311.2, 634, 635, 638, 678, 346.03, 248/669, 637; 417/363
See application file for complete search history.

(56) References Cited

U.S. PATENT DOCUMENTS

| | | | |
|---|---|---|---|
| 815,812 | A | 3/1906 | Gow |
| 1,057,613 | A | 4/1913 | Baldwin |

(Continued)

FOREIGN PATENT DOCUMENTS

| | | |
|---|---|---|
| CA | 2647511 | 10/2007 |
| EP | 301285 | 10/1991 |

(Continued)

OTHER PUBLICATIONS

International Search Report of the International Searching Authority for Patent Cooperation Treaty Application No. PCT/US2007/079350, dated Apr. 2, 2008, pp. 1-2.

(Continued)

*Primary Examiner* — Nkeisha Smith
(74) *Attorney, Agent, or Firm* — Edmonds & Nolte, PC

(57) ABSTRACT

A mounting system for an industrial compression system including a first component close-coupled to a second component includes a first support for the first component. The first support is configured to resist movement of the first component in a first direction substantially horizontal relative to the first component, a second direction substantially vertical relative to the first component, and an axial direction relative to the first component. The mounting system also includes a second support for the second component. The second support is configured to resist movement of the second component in a first direction substantially horizontal relative to the second component and a second direction substantially vertical relative to the second component, wherein the second support permits movement of the second component in an axial direction relative to the second component.

17 Claims, 3 Drawing Sheets

(56) References Cited

U.S. PATENT DOCUMENTS 1,061,656 A 5/1913 Black
1,480,775 A 1/1924 Marien
1,622,768 A 3/1927 Cook et al.
1,642,454 A 9/1927 Malmstrom
2,006,244 A 6/1935 Kopsa
2,300,766 A 11/1942 Baumann
2,328,031 A 8/1943 Risley
2,345,437 A 3/1944 Tinker
2,602,462 A 7/1952 Barrett
2,811,303 A 10/1957 Ault et al.
2,836,117 A 5/1958 Lankford
2,868,565 A 1/1959 Suderow
2,897,917 A 8/1959 Hunter
2,932,360 A 4/1960 Hungate
2,954,841 A 10/1960 Reistle
3,044,657 A 7/1962 Horton
3,191,364 A 6/1965 Sylvan
3,198,214 A 8/1965 Lorenz
3,204,696 A 9/1965 De Priester et al.
3,213,794 A 10/1965 Adams
3,220,245 A 11/1965 Van Winkle
3,273,325 A 9/1966 Gerhold
3,352,577 A 11/1967 Medney
3,395,511 A 8/1968 Akerman
3,402,434 A 1/1969 Swearingen
3,430,799 A * 3/1969 Maier ..... 220/3.94
3,454,163 A 7/1969 Read
3,487,432 A 12/1969 Jenson
3,490,209 A 1/1970 Fernandes et al.
3,500,614 A 3/1970 Soo
3,578,342 A 5/1971 Satterthwaite et al.
3,628,812 A 12/1971 Larraide et al.
3,672,733 A 1/1972 Arsenius et al.
3,814,486 A 6/1974 Schurger
3,829,179 A 8/1974 Kurita et al.
3,915,673 A 10/1975 Tamai et al.
3,975,123 A 8/1976 Schibbye
4,033,647 A 7/1977 Beavers
4,059,364 A 11/1977 Anderson et al.
4,078,809 A 3/1978 Garrick et al.
4,087,261 A 5/1978 Hays
4,103,899 A 8/1978 Turner
4,112,687 A 9/1978 Dixon
4,117,359 A 9/1978 Wehde
4,135,542 A 1/1979 Chisholm
4,141,283 A 2/1979 Swanson et al.
4,146,261 A 3/1979 Edmaier et al.
4,165,622 A 8/1979 Brown, Jr.
4,174,925 A 11/1979 Pfenning et al.
4,182,480 A 1/1980 Theyse et al.
4,197,990 A 4/1980 Carberg et al.
4,205,927 A 6/1980 Simmons
4,227,373 A 10/1980 Amend et al.
4,258,551 A 3/1981 Ritzi
4,259,045 A 3/1981 Teruyama
4,278,200 A 7/1981 Gunnewig
4,298,311 A 11/1981 Ritzi
4,333,748 A 6/1982 Erickson
4,334,592 A 6/1982 Fair
4,336,693 A 6/1982 Hays et al.
4,339,923 A 7/1982 Hays et al.
4,347,900 A 9/1982 Barrington
4,363,608 A 12/1982 Mulders
4,374,583 A 2/1983 Barrington
4,375,975 A 3/1983 McNicholas
4,382,804 A 5/1983 Mellor
4,384,724 A 5/1983 Derman et al.
4,391,102 A 7/1983 Studhalter et al.
4,396,361 A 8/1983 Fraser
4,432,470 A 2/1984 Sopha
4,438,638 A 3/1984 Hays et al.
4,441,322 A 4/1984 Ritzi
4,442,925 A 4/1984 Fukushima et al.
4,453,893 A 6/1984 Hutmaker
4,463,567 A 8/1984 Amend et al.
4,468,234 A 8/1984 McNicholas
4,471,795 A 9/1984 Linhardt
4,477,223 A 10/1984 Giroux
4,502,839 A 3/1985 Maddox et al.
4,511,309 A 4/1985 Maddox
4,531,888 A 7/1985 Buchelt
4,536,134 A 8/1985 Huiber
4,541,531 A 9/1985 Brule
4,541,607 A 9/1985 Hotger
4,573,527 A 3/1986 McDonough
4,574,815 A 3/1986 West et al.
4,648,806 A 3/1987 Alexander
4,687,017 A 8/1987 Danko et al.
4,737,081 A 4/1988 Nakajima et al.
4,752,185 A 6/1988 Butler et al.
4,807,664 A 2/1989 Wilson et al.
4,813,495 A 3/1989 Leach
4,821,737 A 4/1989 Nelson
4,826,403 A 5/1989 Catlow
4,830,331 A 5/1989 Vindum
4,832,709 A 5/1989 Nagyszalanczy
4,904,284 A 2/1990 Hanabusa
4,984,830 A 1/1991 Saunders
4,993,682 A * 2/1991 Imai et al. ..... 248/638
5,007,328 A 4/1991 Otterman
5,024,585 A 6/1991 Kralovec
5,043,617 A 8/1991 Rostron
5,044,701 A 9/1991 Watanabe et al.
5,045,046 A 9/1991 Bond
5,048,302 A * 9/1991 Hagenlocher et al. ..... 62/228.4
5,054,995 A 10/1991 Kaseley et al.
5,064,452 A 11/1991 Yano et al.
5,080,137 A 1/1992 Adams
5,190,440 A 3/1993 Maier et al.
5,202,024 A 4/1993 Andersson et al.
5,202,026 A 4/1993 Lema
5,203,891 A 4/1993 Lema
5,207,810 A 5/1993 Sheth
5,211,427 A 5/1993 Washizu
5,230,612 A * 7/1993 Murphy ..... 417/350
5,246,346 A 9/1993 Schiesser
5,285,123 A 2/1994 Kataoka et al.
5,306,051 A 4/1994 Loker et al.
5,322,307 A * 6/1994 Tilton et al. ..... 280/47.24
5,337,779 A 8/1994 Fukuhara
5,378,121 A 1/1995 Hackett
5,385,446 A 1/1995 Hays
5,421,708 A 6/1995 Utter
5,443,581 A 8/1995 Malone
5,484,521 A 1/1996 Kramer
5,496,394 A 3/1996 Nied
5,500,039 A 3/1996 Mori et al.
5,525,034 A 6/1996 Hays
5,525,146 A 6/1996 Straub
5,531,811 A 7/1996 Kloberdanz
5,538,259 A 7/1996 Uhrner et al.
5,542,831 A 8/1996 Scarfone
5,575,309 A 11/1996 Connell
3,431,747 A 12/1996 Hasheimi et al.
5,585,000 A 12/1996 Sassi
5,605,172 A 2/1997 Schubert et al.
5,628,623 A 5/1997 Skaggs
5,634,492 A 6/1997 Steinruck et al.
5,640,472 A 6/1997 Meinzer et al.
5,641,280 A 6/1997 Timuska
5,653,347 A 8/1997 Larsson
5,664,420 A 9/1997 Hays
5,682,759 A 11/1997 Hays
5,683,235 A 11/1997 Welch
5,685,691 A 11/1997 Hays
5,687,249 A 11/1997 Kato
5,693,125 A 12/1997 Dean
5,697,249 A 12/1997 Miguchi
5,703,424 A 12/1997 Dorman
5,709,528 A 1/1998 Hablanian
5,713,720 A 2/1998 Barhoum
5,720,799 A 2/1998 Hays
5,750,040 A 5/1998 Hays
5,775,882 A 7/1998 Kiyokawa et al.

(56) References Cited

U.S. PATENT DOCUMENTS 5,779,619 A 7/1998 Borgstrom et al.
5,795,135 A 8/1998 Nyilas et al.
5,800,092 A 9/1998 Nill et al.
5,848,616 A 12/1998 Vogel et al.
5,850,857 A 12/1998 Simpson
5,853,585 A 12/1998 Nesseth
5,863,023 A 1/1999 Evans et al.
5,899,435 A 5/1999 Mitsch et al.
5,935,053 A 8/1999 Strid
5,938,803 A 8/1999 Dries
5,938,819 A 8/1999 Seery
5,946,915 A 9/1999 Hays
5,951,066 A 9/1999 Lane et al.
5,965,022 A 10/1999 Gould
5,967,746 A 10/1999 Hagi et al.
5,971,702 A 10/1999 Afton et al.
5,971,907 A 10/1999 Johannemann et al.
5,980,218 A 11/1999 Takahashi et al.
5,988,524 A 11/1999 Odajima et al.
6,035,934 A 3/2000 Stevenson et al.
6,059,539 A 5/2000 Nyilas et al.
6,068,447 A 5/2000 Foege
6,090,174 A 7/2000 Douma et al.
6,090,299 A 7/2000 Hays et al.
6,113,675 A 9/2000 Branstetter
6,122,915 A 9/2000 Hays
6,123,363 A 9/2000 Burgard et al.
6,145,844 A 11/2000 Waggott
6,149,825 A 11/2000 Gargas
6,151,881 A 11/2000 Ai et al.
6,196,962 B1 3/2001 Purvey et al.
6,206,202 B1 3/2001 Galk et al.
6,214,075 B1 4/2001 Filges et al.
6,217,637 B1 4/2001 Toney et al.
6,227,379 B1 5/2001 Nesseth
6,277,278 B1 8/2001 Conrad et al.
6,312,021 B1 11/2001 Thomas
6,314,738 B1 11/2001 Hays
6,372,006 B1 4/2002 Pregenzer et al.
6,375,437 B1 * 4/2002 Nolan ..... 417/234
6,383,262 B1 5/2002 Marthinsen et al.
6,394,764 B1 5/2002 Samurin
6,398,973 B1 6/2002 Saunders et al.
6,402,465 B1 6/2002 Maier
6,426,010 B1 7/2002 Lecoffre et al.
6,464,469 B1 10/2002 Grob et al.
6,467,988 B1 10/2002 Czachor et al.
6,468,426 B1 10/2002 Klass
6,485,536 B1 11/2002 Masters
6,530,484 B1 3/2003 Bosman
6,530,979 B2 3/2003 Firey
6,531,066 B1 3/2003 Saunders et al.
6,537,035 B2 3/2003 Shumway
6,540,917 B1 4/2003 Rachels et al.
6,547,037 B2 4/2003 Kuzdzal
6,592,654 B2 7/2003 Brown
6,596,046 B2 7/2003 Conrad et al.
6,599,086 B2 7/2003 Soja
6,607,348 B2 8/2003 Jean
6,616,719 B1 9/2003 Sun et al.
6,617,731 B1 9/2003 Goodnick
6,629,825 B2 10/2003 Stickland et al.
6,631,617 B1 10/2003 Dreiman et al.
6,658,986 B2 12/2003 Pitla et al.
6,659,143 B1 12/2003 Taylor et al.
6,669,845 B2 12/2003 Klass
6,688,802 B2 2/2004 Ross et al.
6,707,200 B2 3/2004 Carroll et al.
6,718,955 B1 4/2004 Knight
6,719,830 B2 4/2004 Illingworth et al.
6,764,284 B2 7/2004 Oehman, Jr.
6,776,812 B2 8/2004 Komura et al.
6,802,693 B2 10/2004 Reinfeld et al.
6,802,881 B2 10/2004 Illingworth et al.
6,811,713 B2 11/2004 Arnaud
6,817,846 B2 11/2004 Bennitt
6,837,913 B2 1/2005 Schilling et al.
6,843,836 B2 1/2005 Kitchener
6,878,187 B1 4/2005 Hays et al.
6,893,208 B2 5/2005 Frosini et al.
6,907,933 B2 6/2005 Choi et al.
6,923,627 B1 * 8/2005 Wood et al. ..... 417/234
6,979,358 B2 12/2005 Ekker
7,001,448 B1 2/2006 West
7,013,978 B2 3/2006 Appleford et al.
7,022,150 B2 4/2006 Borgstrom et al.
7,022,153 B2 4/2006 McKenzie
7,025,890 B2 4/2006 Moya
7,033,410 B2 4/2006 Hilpert et al.
7,033,411 B2 4/2006 Carlsson et al.
7,056,363 B2 6/2006 Carlsson et al.
7,063,465 B1 6/2006 Wilkes et al.
7,112,036 B2 9/2006 Lubell et al.
7,131,292 B2 11/2006 Ikegami et al.
7,144,226 B2 12/2006 Pugnet et al.
7,159,723 B2 1/2007 Hilpert et al.
7,160,518 B2 1/2007 Chen et al.
7,169,305 B2 1/2007 Gomez
7,185,447 B2 3/2007 Arbeiter
7,204,241 B2 4/2007 Thompson
7,241,392 B2 7/2007 Maier
7,244,111 B2 7/2007 Suter et al.
7,258,713 B2 8/2007 Eubank et al.
7,270,145 B2 9/2007 Koezler
7,288,202 B2 10/2007 Maier
7,314,560 B2 1/2008 Yoshida et al.
7,323,023 B2 1/2008 Michele et al.
7,328,749 B2 2/2008 Reitz
7,335,313 B2 2/2008 Moya
7,377,110 B2 5/2008 Sheridan et al.
7,381,235 B2 6/2008 Koene et al.
7,396,373 B2 7/2008 Lagerstedt et al.
7,399,412 B2 7/2008 Keuschnigg
7,435,290 B2 10/2008 Lane et al.
7,445,653 B2 11/2008 Trautmann et al.
7,470,299 B2 12/2008 Han et al.
7,473,083 B2 1/2009 Oh et al.
7,479,171 B2 1/2009 Cho et al.
7,494,523 B2 2/2009 Oh et al.
7,501,002 B2 3/2009 Han et al.
7,520,210 B2 4/2009 Theodore, Jr. et al.
7,575,422 B2 8/2009 Bode et al.
7,578,863 B2 8/2009 Becker et al.
7,591,882 B2 9/2009 Harazim
7,594,941 B2 9/2009 Zheng et al.
7,594,942 B2 9/2009 Polderman
7,610,955 B2 11/2009 Irwin, Jr.
7,628,836 B2 12/2009 Baronet et al.
7,637,699 B2 12/2009 Albrecht
7,674,377 B2 3/2010 Carew
7,677,308 B2 3/2010 Kolle
7,708,537 B2 5/2010 Bhatia et al.
7,708,808 B1 5/2010 Heumann
7,744,663 B2 6/2010 Wallace
7,748,079 B2 7/2010 McDowell et al.
7,766,989 B2 8/2010 Lane et al.
7,811,344 B1 10/2010 Duke et al.
7,811,347 B2 10/2010 Carlsson et al.
7,815,415 B2 10/2010 Kanezawa et al.
7,824,458 B2 11/2010 Borgstrom et al.
7,824,459 B2 11/2010 Borgstrom et al.
7,846,228 B1 12/2010 Saaski et al.
2001/0007283 A1 7/2001 Johal et al.
2002/0009361 A1 1/2002 Reichert et al.
2003/0029318 A1 2/2003 Firey
2003/0035718 A1 2/2003 Langston et al.
2003/0136094 A1 7/2003 Illingworth et al.
2004/0007261 A1 1/2004 Cornwell
2004/0170505 A1 9/2004 Lenderink et al.
2005/0173337 A1 8/2005 Costinel
2006/0065609 A1 3/2006 Arthur
2006/0090430 A1 5/2006 Trautman et al.
2006/0096933 A1 5/2006 Maier
2006/0157251 A1 7/2006 Stinessen et al.

(56) References Cited

U.S. PATENT DOCUMENTS

| | | | |
|---|---|---|---|
| 2006/0157406 | A1 | 7/2006 | Maier |
| 2006/0193728 | A1 | 8/2006 | Lindsey et al. |
| 2006/0222515 | A1 | 10/2006 | Delmotte et al. |
| 2006/0230933 | A1 | 10/2006 | Harazim |
| 2006/0239831 | A1 | 10/2006 | Garris, Jr. |
| 2006/0254659 | A1 | 11/2006 | Bellott et al. |
| 2006/0275160 | A1 | 12/2006 | Leu et al. |
| 2007/0029091 | A1 | 2/2007 | Stinessen et al. |
| 2007/0036646 | A1 | 2/2007 | Nguyen et al. |
| 2007/0051245 | A1 | 3/2007 | Yun |
| 2007/0062374 | A1 | 3/2007 | Kolle |
| 2007/0065317 | A1 | 3/2007 | Stock |
| 2007/0084340 | A1 | 4/2007 | Dou et al. |
| 2007/0140870 | A1 | 6/2007 | Fukanuma et al. |
| 2007/0151922 | A1 | 7/2007 | Mian |
| 2007/0163215 | A1 | 7/2007 | Lagerstadt |
| 2007/0172363 | A1 | 7/2007 | Laboube et al. |
| 2007/0196215 | A1 | 8/2007 | Frosini et al. |
| 2007/0227969 | A1 | 10/2007 | Dehaene et al. |
| 2007/0294986 | A1 | 12/2007 | Beetz |
| 2008/0031732 | A1 | 2/2008 | Peer et al. |
| 2008/0039732 | A9 | 2/2008 | Bowman |
| 2008/0246281 | A1 | 10/2008 | Agrawal et al. |
| 2008/0315812 | A1 | 12/2008 | Balboul |
| 2009/0013658 | A1 | 1/2009 | Borgstrom et al. |
| 2009/0015012 | A1 | 1/2009 | Metzler et al. |
| 2009/0025562 | A1 | 1/2009 | Hallgren et al. |
| 2009/0025563 | A1 | 1/2009 | Borgstrom et al. |
| 2009/0151928 | A1 | 6/2009 | Lawson |
| 2009/0159523 | A1 | 6/2009 | McCutchen |
| 2009/0169407 | A1 | 7/2009 | Yun |
| 2009/0173095 | A1 | 7/2009 | Bhatia et al. |
| 2009/0266231 | A1 | 10/2009 | Franzen et al. |
| 2009/0304496 | A1 | 12/2009 | Maier |
| 2009/0321343 | A1 | 12/2009 | Maier |
| 2009/0324391 | A1 | 12/2009 | Maier |
| 2010/0007133 | A1 | 1/2010 | Maier |
| 2010/0021292 | A1 | 1/2010 | Maier et al. |
| 2010/0038309 | A1 | 2/2010 | Maier |
| 2010/0043288 | A1 | 2/2010 | Wallace |
| 2010/0043364 | A1 | 2/2010 | Curien |
| 2010/0044966 | A1 | 2/2010 | Majot et al. |
| 2010/0072121 | A1 | 3/2010 | Maier |
| 2010/0074768 | A1 | 3/2010 | Maier |
| 2010/0083690 | A1 | 4/2010 | Sato et al. |
| 2010/0090087 | A1 | 4/2010 | Maier |
| 2010/0143172 | A1 | 6/2010 | Sato et al. |
| 2010/0163232 | A1 | 7/2010 | Kolle |
| 2010/0183438 | A1 | 7/2010 | Maier et al. |
| 2010/0239419 | A1 | 9/2010 | Maier et al. |
| 2010/0239437 | A1 | 9/2010 | Maier |
| 2010/0247299 | A1 | 9/2010 | Maier |
| 2010/0257827 | A1 | 10/2010 | Lane et al. |
| 2011/0017307 | A1 | 1/2011 | Kidd et al. |
| 2011/0061536 | A1 | 3/2011 | Maier et al. |

FOREIGN PATENT DOCUMENTS

| | | |
|---|---|---|
| EP | 1582703 | 10/2005 |
| EP | 2013479 | 1/2009 |
| EP | 7838631.5 | 12/2009 |
| GB | 2323639 | 9/1998 |
| GB | 2337561 | 11/1999 |
| JP | 54099206 | 1/1978 |
| JP | 08 068501 | 3/1996 |
| JP | 8-284961 A | 11/1996 |
| JP | 2002 242699 | 8/2002 |
| JP | 2004034017 A | 2/2004 |
| JP | 3711028 | 10/2005 |
| JP | 2005291202 | 10/2005 |
| KR | 2009085521 | 2/2008 |
| MX | 2008012579 | 12/2008 |
| WO | 9524563 | 9/1995 |
| WO | 0117096 | 3/2001 |
| WO | 2007043889 | 4/2007 |
| WO | 2007103248 | 9/2007 |
| WO | 2007120506 | 10/2007 |
| WO | 2008036221 | 3/2008 |
| WO | 2008039446 | 3/2008 |
| WO | 2008039491 | 4/2008 |
| WO | 2008039731 | 4/2008 |
| WO | 2008039732 | 4/2008 |
| WO | 2008039733 | 4/2008 |
| WO | 2008039734 | 4/2008 |
| WO | 2008036394 | 7/2008 |
| WO | 2009111616 | 9/2009 |
| WO | 2009158252 | 12/2009 |
| WO | 2009158253 | 12/2009 |
| WO | 2010083416 | 7/2010 |
| WO | 2010083427 | 7/2010 |
| WO | 2010107579 | 9/2010 |
| WO | 2010110992 | 9/2010 |
| WO | 2011034764 | 3/2011 |

OTHER PUBLICATIONS

Technical Manual—High Pressure Air Compressor Model 13NL45; Navsea S6220-AT-MMA-010/93236, pp. 3-23 to 3-32, Electric Boat Corporation, Groton, CT 06340, Oct. 28, 1991.

PCT/US2007/008149 International Preliminary Report on Patentability dated Sep. 30, 2008.

PCT/US2007/008149 International Search Report and Written Opinion dated Jul. 17, 2008.

PCT/US2007/020101 International Preliminary Report on Patentability dated Apr. 2, 2009.

PCT/US2007/020101 International Search Report dated Apr. 29, 2008.

PCT/US2007/020101 Written Opinion dated Mar. 19, 2009.

PCT/US2007/020471 International Preliminary Report on Patentability dated Apr. 2, 2009.

PCT/US2007/020471 International Search Report and Written Opinion dated Apr. 1, 2008.

PCT/US2007/020659 International Preliminary Report on Patentability dated Mar. 31, 2009.

PCT/US2007/020659 International Search Report and Written Opinion dated Sep. 17, 2008.

PCT/US2007/020768 International Preliminary Report on Patentability dated Mar. 31, 2009.

PCT/US2007/020768 International Search Report and Written Opinion dated Mar. 3, 2008.

PCT/US2007/079348 International Preliminary Report on Patentability dated Mar. 31, 2009.

PCT/US2007/079348 International Search Report dated Apr. 11, 2008.

PCT/US2007/079348 Written Opinion dated Jan. 25, 2008.

PCT/US2007/079349 International Preliminary Report on Patentability dated Mar. 31, 2009.

PCT/US2007/079349 International Search Report and Written Opinion dated Apr. 2, 2008.

PCT/US2007/079350 International Preliminary Report on Patentability dated Mar. 31, 2009.

PCT/US2007/079350 International Search Report dated Jul. 17, 2008.

PCT/US2007/079350 Written Opinion dated Mar. 25, 2009.

PCT/US2007/079352 International Preliminary Report on Patentability dated Mar. 31, 2009.

PCT/US2007/079352 International Search Report and Written Opinion dated Aug. 27, 2008.

PCT/US2009/036142 International Preliminary Report on Patentability dated Sep. 16, 2010.

PCT/US2009/036142 International Search Report dated Jan. 7, 2010.

PCT/US2009/036142 Written Opinion dated May 11, 2009.

PCT/US2009/047662 International Preliminary Report on Patentability dated Jan. 13, 2011.

PCT/US2009/047662 Written Opinion dated Aug. 20, 2009.

PCT/US2010/021199 International Search Report and Written Opinion dated Mar. 22, 2010.

(56) References Cited

OTHER PUBLICATIONS

PCT/US2010/021199 International Preliminary Report on Patentability dated Mar. 29, 2011.
PCT/US2010/021218 International Search Report and Written Opinion dated Mar. 23, 2010.
PCT/US2010/021218 International Report on Patentability dated Feb. 2, 2011.
PCT/US2010/025650 International Search Report and Written Opinion dated Apr. 22, 2010.
PCT/US2010/025650 International Report on Patentability dated Mar. 14, 2011.
PCT/US2010/025952 International Search Report and Written Opinion dated Apr. 12, 2010.
PCT/US2010/025952 International Report on Patentability dated Mar. 14, 2011.
PCT/US2009/047667 International Report on Patentability dated Jan. 13, 2011.
PCT/US2009/047667 Written Opinion dated Aug. 7, 2009.
PCT/US2009/047667 International Search Report dated Dec. 30, 2009.
Dresser-Rand, Inc. "High Pressure Air Compressor Model 13NL45," Oct. 28, 1991, 14 pages.

* cited by examiner

COMPRESSOR MOUNTING SYSTEM

CROSS REFERENCE

This application is a United States national phase application of co-pending international patent application number PCT/US2007/079350, filed Sep. 25, 2007, which claims priority to U.S. Provisional Patent Application No. 60/826,876, filed Sep. 25, 2006, the disclosures of which are incorporated herein by reference.

BACKGROUND

The present invention relates to compressor mounting systems and, more particularly, to a pedestal based mounting system for a close-coupled industrial compression system including heat exchangers and gas break vessels.

As compression system technology has advanced, compression systems have become increasingly sophisticated and energy efficient. For example, heat exchangers and gas break vessels have been incorporated into compression systems as separate components integrated with the compressor and motor driver to improve system performance and efficiency. As a result of incorporating additional features such as heat exchangers, industrial compression systems have become larger and are commonly mounted with components connected end-to-end in a compression system train. While performance and efficiency has improved in these types of systems, the size and weight of such systems has grown.

To incorporate performance and efficiency advantages of components, such as heat exchangers, while maintaining a smaller package, a type of compression system is provided with a compressor close-coupled to an electric motor driver. This arrangement allows for a compact design with benefits over traditional base-plate mounted compressor trains. A further extension of this concept is to incorporate process heat exchangers into a compact interconnected package. Currently, process heat exchangers are mounted remotely from the compressor with long, voluminous extensions of interconnected process piping.

SUMMARY

In one embodiment, the invention provides a mounting system for an industrial compression system including a first component close-coupled to a second component. The mounting system includes a first support for the first component, the first support configured to resist movement of the first component in a first direction substantially horizontal relative to the first component, a second direction substantially vertical relative to the first component, and an axial direction relative to the first component. The mounting system also includes a second support for the second component, the second support configured to resist movement of the second component in a first direction substantially horizontal relative to the second component and a second direction substantially vertical relative to the second component, wherein the second support permits movement of the second component in an axial direction relative to the second component.

In another embodiment, the invention provides a mounting system for a compression system having a motor dual-ended to a first compressor and a second compressor. The mounting system includes a first support for the first compressor, the first support configured to resist movement of the first compressor in a first direction substantially horizontal relative to the first compressor, a second direction substantially vertical relative to the first compressor, and an axial direction. The mounting system also includes a second support for the second compressor, the second support configured to resist movement of the second compressor in a first direction substantially horizontal relative to the first compressor, a second direction substantially vertical relative to the second compressor, and an axial direction. A beam extends between the first and second supports, wherein the beam supports the motor, and further wherein movement of the motor is permitted in an axial direction.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

For example, terms like "central", "upper", "lower", "front", "rear", and the like are only used to simplify description of the present invention, and do not alone indicate or imply that the device or element referred to must have a particular orientation. The elements of the industrial compressor mounting system referred to in the present invention can be installed and operated in any workable orientation desired. In addition, terms such as "first", "second", and "third", are used herein for purposes of description and are not intended to indicate or imply relative importance or significance.

DETAILED DESCRIPTION

Figure 1:
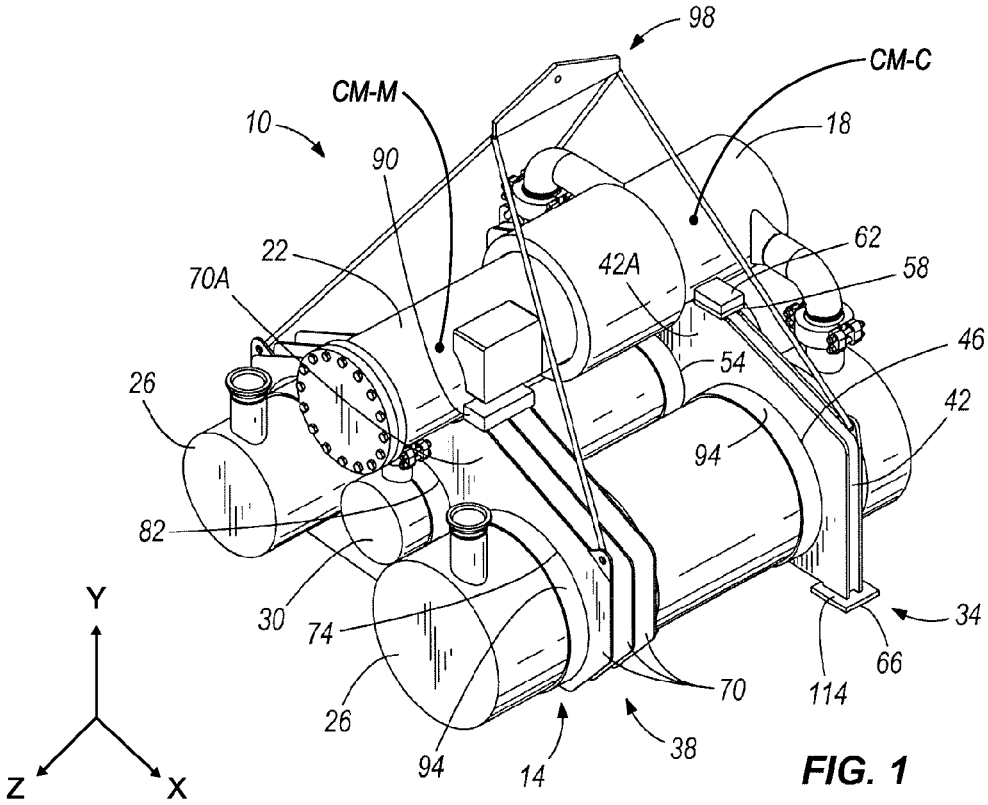
FIG. 1 is a perspective view of a close-coupled industrial compression system including a compressor mounting system according to one embodiment of the invention.

FIG. 1 illustrates a close-coupled industrial compression system 10 utilizing a compressor mounting system 14 according to one embodiment of the invention. A compressor 18 is connected to, and close-coupled with, a motor driver 22. Heat exchangers 26 are mounted vertically below and horizontally outward from the close-coupled system 10, and a gas break vessel 30 is mounted vertically below the compressor 18 and the motor 22. All of these components are supported and positioned by the mounting system 14. In order to place the compressor 18, the motor 22, and the heat exchangers 26 in a compact package, the components are vertically and horizontally in close proximity in an interconnected relationship. The mounting system 14 may accommodate long and short time scale positional variations between the components in order to avoid machinery misalignment and transfer of large forces between the components. Additionally, the mounting system 14 supports the weight of each of the components.

The compressor mounting system 14 includes a rigid pedestal 34, and a partially-flexible pedestal 38. The pedestals 34, 38 provide a combination of rigid and flexible support that enables close-coupled, interconnection and support of the components of the industrial compression system 10. The mounting system 14 provides rigid support to the components that require rigid support (e.g., the compressor 18) and simultaneously provides flexible support of certain components (e.g., the motor 22) to permit relative movement in directions that are beneficial to operation and performance of the system 10. The mounting system 14 positions components vertically and horizontally with respect to each other in close proximity while permitting appropriate relative movement between the components.

Figure 2:
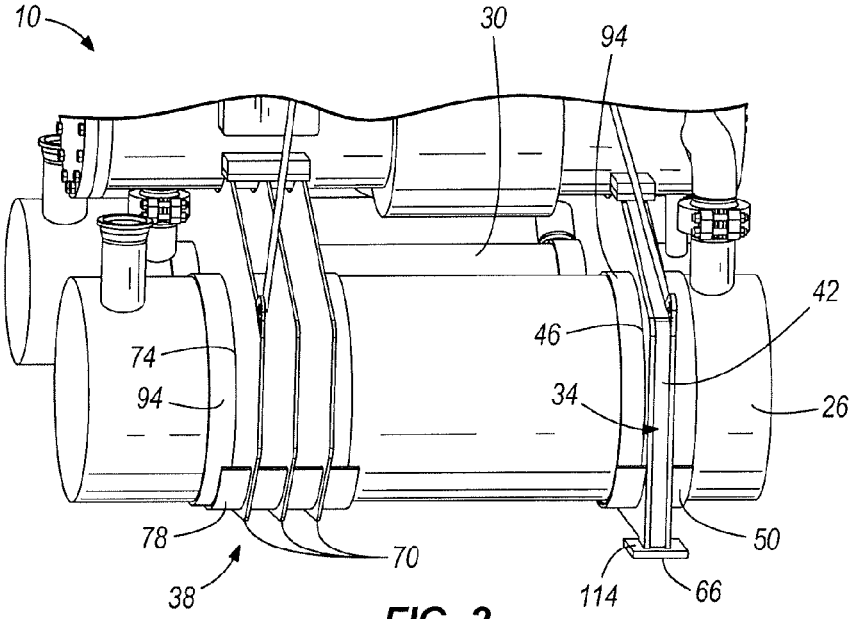
FIG. 2 is a front perspective view of the compressor mounting system shown in FIG. 1.

Referring to FIGS. 1 and 2, the pedestal 34 includes a generally rectangular pedestal plate 42 positioned approximately vertically under a center of mass CM-C of the compressor 18. The pedestal plate 42 includes openings 46 to position and support the heat exchangers 26 of the industrial compression system 10, whereby vessel supports 50 are positioned between the heat exchangers 26 and the plate 42. An opening 54 is also provided in the plate 42 for supporting the gas break vessel 30. An upper portion 42A of the plate 42 includes a flange plate 58 combined with a casing mount 62 for supporting the compressor 18 on the pedestal 34. In the illustrated embodiment, the rigid pedestal 34 is formed from a single plate; however, it should be readily apparent to those of skill in the art that in further embodiments any number of pedestal plates may be used (e.g., two plates axially coupled together). In still another embodiment, the plate may be fabricated from bolted sections split at the heat exchanger interface to allow easier assembly of the heat exchangers into the system 10.

The pedestal 34 supports the compressor 18, and is rigid, or stiff, in a vertical direction (generally along the Y-axis) and a horizontal direction (generally along the X-axis) relative to a supporting surface 66, as well as in an axial direction (generally along the Z-axis) of the compressor 18. It is generally desirable to support the compressor 18 in a fixed position. Rigidity is given to the pedestal 34 through a selection of material thickness of the plate 42 and appropriate structural re-enforcement.

The partially-flexible pedestal 38, is positioned approximately vertically under a center of mass CM-M of the motor 22, axially spaced from the pedestal 34. The pedestal 38 is rigid in a vertical direction (generally along the Y-axis) and a horizontal direction (generally along the X-axis) relative to the supporting surface 66, but is flexible, soft or compliant in an axial direction (generally along the Z-axis) relative to the motor 22. The pedestal 38 includes three flex plates 70, which support the motor 22 and provide axial compliance. The pedestal plates 70 include openings 74 to position and support the heat exchangers 26 of the industrial compression system 10, whereby vessel supports 78 are positioned between the heat exchangers 26 and the plates 70. Openings 82 are also provided in the plates 70 for supporting the gas break vessel 30. The plates permit relative axial movement of the heat exchangers 26 and the gas break vessel 30. An upper portion 70A of the flex plates 70 includes a casing mount 90 for supporting the motor 22 and permitting axial movement of the motor 22.

The pedestal 38 is rigid in some directions but flexible in others to permit movement in a manner that is non-detrimental to intercomponent positioning and operation. Flexible mounting is accomplished through flexible pedestals, isolation pads or bands, flex plates and flange plates. In a further embodiment, similar axial movement flexibility is obtained with a completely rigid pedestal (similar to compressor pedestal 34) including a system of axial keyways and sliding or rolling surfaces to allow the motor 22 and the heat exchangers 26 to freely move in an axial direction (generally along the Z-axis) without relatively shifting position in a vertical direction (generally along the Y-axis) or a horizontal direction (generally along the X-axis).

Isolation pads 94 are positioned in multiple locations within the mounting system 14 to permit relative axial movement between a structural support piece and the supported component. Referring to FIG. 2, isolation pads 94 are located at each connection between the pedestals 34, 38 and the heat exchangers 26 and the gas break vessel 30. The isolation pads 94 permit the heat exchangers 26 to move axially (and to a smaller extent, horizontally) with piping, or temperature induced loads without affecting alignment of the compressor 18, the motor 22 and the interconnecting piping. The isolation pads 94 also minimize transmission of flow induced vibrations from the heat exchanger 26 to the close-coupled compressor and motor unit. In the illustrated embodiment, the isolation pads 94 are formed by an elastomer band. In further embodiments, flexible support may be provided by other means, such as elastomer-mounted rollers, low friction pads, anti-friction bearings, or the like, to allow a larger degree of relative axial movement.

Figure 3:
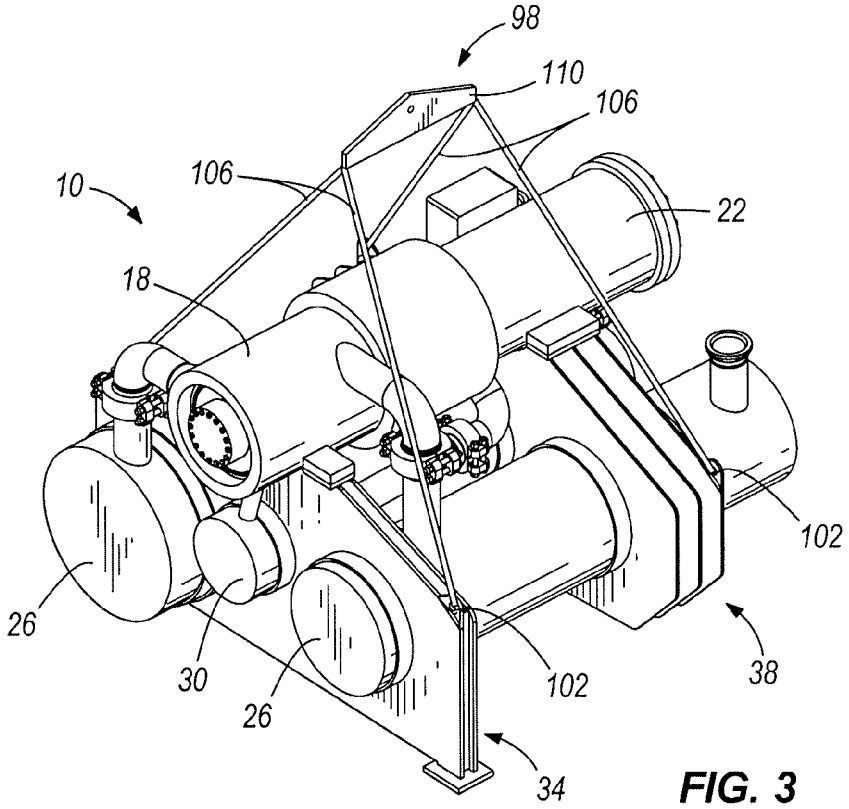
FIG. 3 is a rear perspective view of the compression system shown in FIG. 1, and illustrates lifting and transporting features of the compressor mounting system.

FIG. 3 illustrates a lifting system 98 that permits the industrial compression system 10 to be lifted and transported as a complete unit. The lifting system 98 includes lifting lugs 102 positioned at appropriate and strategic locations on the pedestals 34, 38. The lifting lugs 102 are connected with cables 106, or similar structures, such as rods, to a single point lift 110. The compression system 10 is lifted and transported through the single point lift 110.

Figure 4:
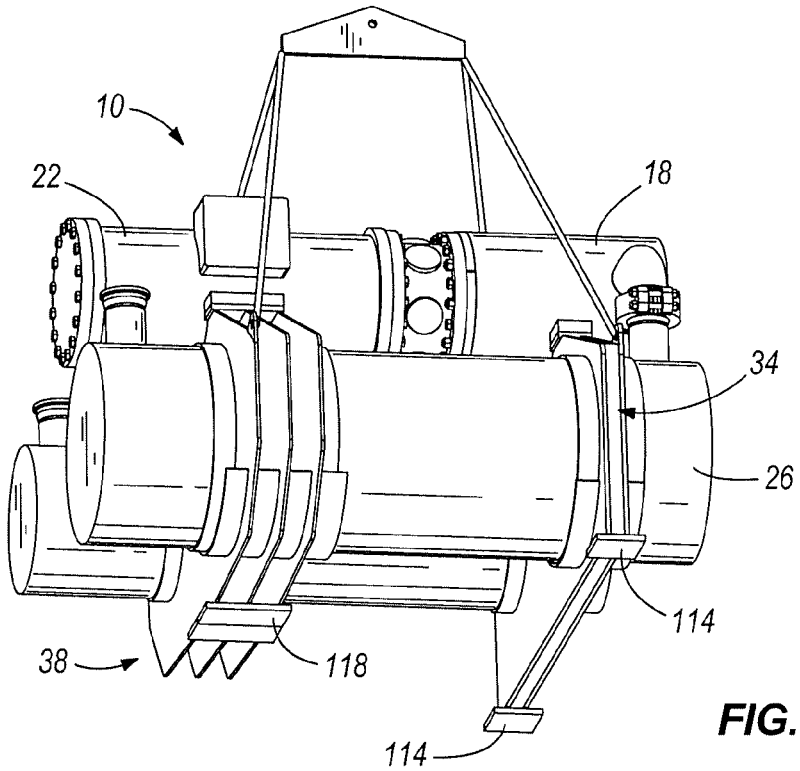
FIG. 4 is a bottom perspective view of the compressor mounting system shown in FIG. 1.

As shown in FIG. 4, the industrial compression system 10, along with the pedestals 34, 38, is supported by a three point mounting base system. The mounting base system includes two pedestal base supports 114 positioned on a lower face, and at each end, of the plates 42 of the pedestal 34. A third base support 118 is centrally located at a lower face of the plates 70 of the pedestal 30. The three base supports provide structural de-coupling between sub-base structures carrying the compression system 10 (such as an off-shore oil platform) and the compression system 10 itself. In a further embodiment, other base systems may be used.

It should be readily appreciated that the mounting system 14, as shown in FIGS. 1-4, supports the compressor 18, the motor 22, heat exchangers 26 and the gas break vessel 30 in a single package forming a relatively compact group of components. Thereby, interconnecting piping between components are shorter and comprised of smaller diameter piping than is typical in a widely-separated train-type configuration. Interconnecting mechanical structures, such as drive components between the motor driver 22 and the compressor 18 are also made shorter and more compact.

A combination of support structures form the mounting system 14, some of which are rigid in all three primary directions (generally along the X, Y, and Z axes illustrated in FIG. 1) and at least one of which is flexible in, at least, an axial direction (generally along the Z-axis illustrated in FIG. 1), and are combined to permit relative movement of close-coupled components in a manner that is beneficial to operation or performance of the compression system. While reference is made herein to the compressor mounting system 14 utilizing a single, rigid pedestal 34 and a single, combination rigid and flexible pedestal 38, it is contemplated that other embodiments of the invention may utilize any number of each of the rigid pedestal and the combination rigid and flexible pedestal. It should be readily apparent to those of skill in the art that in a further embodiment, the pedestals 34, 38 may be reversed such that the rigid pedestal 34 supports the motor 22 and the partially-flexible pedestal 38 supports the compressor 18.

Figure 5:
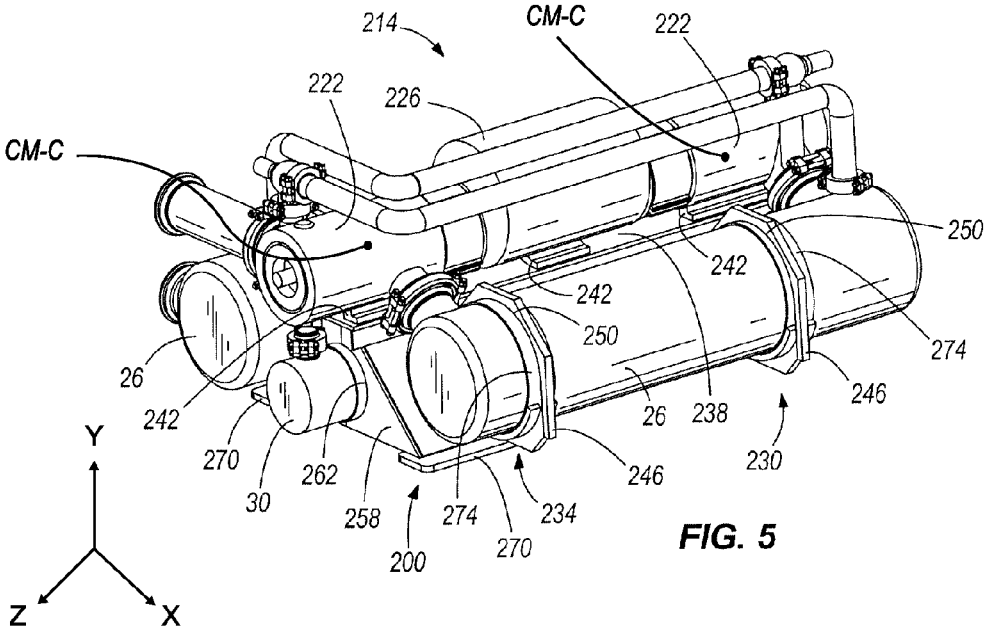
FIG. 5 is a perspective view of a compressor mounting system according to another embodiment of the invention, and configured for use with a close-coupled, single drive, dual-compressor system.
Figure 6:
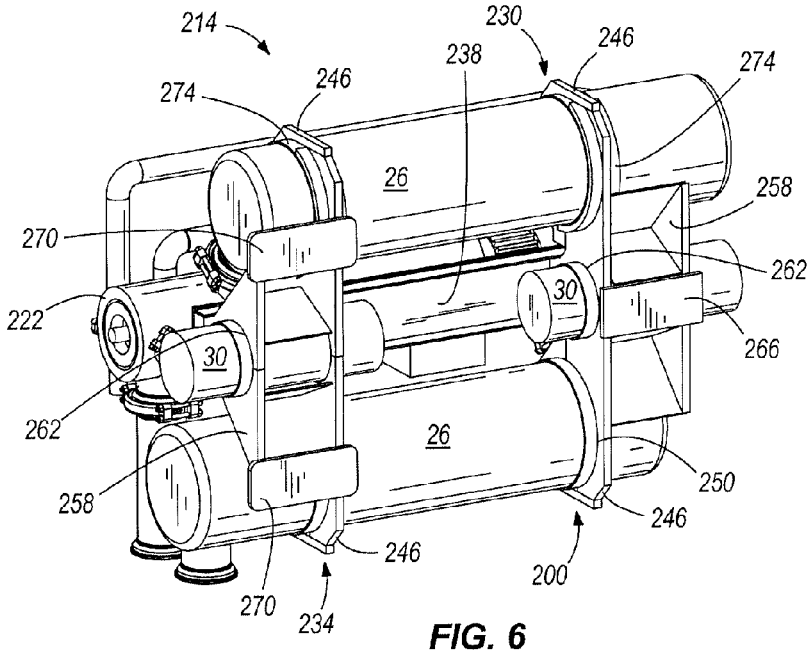
FIG. 6 is a bottom perspective view of the compressor mounting system shown in FIG. 5.

FIGS. 5 and 6 illustrate a compressor mounting system 200 according to another embodiment of the invention. An industrial compressions system 214 is a double compressor drive arrangement including a single electrical drive 226 dual-ended to power two compressors 222. Similar to the compression system 10 shown in FIGS. 1-4, heat exchangers 26 are mounted vertically below and horizontally outward from the close-coupled system 214, and gas break vessel 30 is mounted vertically below the compressors 222. All of these components are supported and positioned by the mounting system 200. In order to place the compressors 222, the motor 226 and the heat exchangers 26 in a compact package, the components are vertically and horizontally in close proximity and in an interconnected relationship.

The mounting system 200 employs isolation pads, flange plates and flex plates to permit positional variation of the components in specific locations and directions that are beneficial to system operation and performance. The mounting system 200 includes two rigid pedestals 230, 234, each of which supports a compressor 222 at a position close to the compressor's center of mass. The pedestals 230, 234 are connected together by a structural beam 238 extending between the pedestals 230, 234. Inter-casing flanges 242 are supported by the structural beam 238 to provide a connection that supports the compressors 222 and the motor 226. The structural beam 238 is structurally sufficient to hold the weight of the dual-ended electrical drive 226 when one or both of the compressors 222 are removed for service. The pedestals 230, 234 are also provided with openings for the heat exchangers 26 and the gas break vessels 30 which are mounted with a structure similar to the mounting utilized in FIGS. 1-4 to permit relative axial movement (generally along the Z-axis) between the pedestals 230, 234 and the heat exchangers 26 and the gas break vessels 30.

Each pedestal 230, 234 includes a plate 246 positioned under a center of mass CM-C for the respective compressor 222. Each plate 246 includes openings 250 to position and support the heat exchangers 26 of the industrial compression system 214, whereby vessel supports 254 are positioned between the heat exchangers 26 and the plates 246. A pedestal base 258 is coupled to each plate 246. Each base 258 includes openings 262 for supporting the gas break vessels 30. Each base 258 has a generally pyramidal shape for distributing weight of the compression system 10.

Referring to FIGS. 5 and 6, in the illustrated embodiment, a three point mounting base system support the pedestals 230, 234. The first pedestal 230 includes a base mount 266 centered on a lower face of the associated pedestal base 258, and the second pedestal 234 includes a pair of base mounts 270 coupled to the lower face of the associated pedestal base 258. As discussed above, isolation pads 274 are positioned between the pedestals 230, 234 and the heat exchangers 26 and the gas break vessels 30 to permit axial movement (generally along the Z-axis) of the components without affecting alignment thereof.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

Since other modifications, changes and substitutions are intended in the foregoing disclosure, it is appropriate that the appended claims be construed broadly and in a manner consistent with the scope of the invention.

What is claimed is:

1. A mounting system for compression system, comprising:

a first support for a first component of the compression system, the first support comprising a pedestal plate positioned under a center of mass of the first component and configured to resist movement of the first component in a first direction substantially horizontal relative to the first component, a second direction substantially vertical relative to the first component, and an axial direction relative to the first component; and a second support for a second component of the compression system, the second support configured to resist movement of the second component in a first direction substantially horizontal relative to the second component and a second direction substantially vertical relative to the second component, wherein the second support permits movement of the second component in an axial direction relative to the second component.

2. The mounting system of claim 1, wherein the pedestal plate is rigid in the first direction substantially horizontal relative to the first component, the second direction substantially vertical relative to the first component, and the axial direction relative to the first component.

3. The mounting system of claim 1, wherein the first support further includes a flange plate and a first casing mount for supporting the first component.

4. The mounting system of claim 1, wherein the second support comprises a plurality of flexible plates positioned under the second component, and wherein each flexible plate of the plurality of flexible plates is rigid in the first direction substantially horizontal relative to the second component and the second direction substantially vertical relative to the second component, and flexible in the axial direction relative to the second component.

5. The mounting system of claim 1, wherein the second support includes a second casing mount for supporting the second component.

6. The mounting system of claim 1, further comprising a lifting system coupled to the first and second supports for facilitating lifting of the compression system, the lifting system comprising at least one lifting lug coupled to the first support, at least one lifting lug coupled to the second support, a point lift, and cables extending between the lifting lugs and the point lift.

7. The mounting system of claim 1, wherein the compression system further comprises a plurality of components positioned below the first and second components, wherein the first and second supports further support the plurality of components.

8. The mounting system of claim 7, further comprising at least one isolation pad positioned between the first support and at least one of the plurality of components.

9. The mounting system of claim 7, further comprising at least one isolation pad positioned between the second support and at least one of the plurality of components.

10. The mounting system of claim 1, wherein movement of the second component in the axial direction permitted by the second support is relative the first component.

11. A mounting system for a compression system, comprising:

a first support for a first compressor of the compression system, the first support configured to resist movement of the first compressor in a first direction substantially horizontal relative to the first compressor, a second direction substantially vertical relative to the first compressor, and an axial direction;

a second support for a second compressor of the compression system, the second support configured to resist movement of the second compressor in a first direction substantially horizontal relative to the second compressor, a second direction substantially vertical relative to the second compressor, and an axial direction, wherein the first and second compressors are coupled to the ends of a dual-ended motor; and a beam extending between the first and second supports, wherein the beam supports the motor, and movement of the motor is permitted in an axial direction.

12. The mounting system of claim 11, wherein the first support comprises a plate positioned under a center of mass of the first compressor, a base coupled to the plate, and a base mount coupled to the base and the plate for supporting the first support on a supporting surface.

13. The mounting system of claim 11, wherein the second support comprises a plate positioned under a center of mass of the second compressor, a base coupled to the plate, and at least one base mount coupled to the base and the plate for supporting the second support on a supporting surface.

14. The mounting system of claim 11, wherein the compression system further comprises a pair of heat exchangers positioned below the first and second compressors, wherein the first and second supports support the heat exchangers.

15. The mounting system of claim 14, further comprising at least one isolation pad positioned between the first support and each heat exchanger.

16. The mounting system of claim 14, further comprising at least one isolation pad positioned between the second support and each heat exchanger.

17. The mounting system of claim 11, wherein movement of the motor in the axial direction is relative the first compressor, the second compressor, or both.

* * * * *